US006708919B2

(12) United States Patent
Newman et al.

(10) Patent No.: US 6,708,919 B2
(45) Date of Patent: Mar. 23, 2004

(54) TURNING BAR ASSEMBLY FOR USE WITH A MOVING WEB

(75) Inventors: Lawrence R. Newman, Huntsville (CA); Brian P. Pratt, Huntsville (CA); Stanley M. Hack, Huntsville (CA); Leslie G. Rowley, Novar (CA)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/101,538

(22) Filed: Mar. 19, 2002

(65) Prior Publication Data

US 2003/0178524 A1 Sep. 25, 2003

(51) Int. Cl.[7] ..... G03B 1/42

(52) U.S. Cl. ..... 242/615.21; 226/188; 226/194; 226/195; 242/419.8

(58) Field of Search ..... 242/615.21, 419.8; 226/188, 194, 195

(56) References Cited

U.S. PATENT DOCUMENTS 4,147,287 A 4/1979 Reba
4,155,496 A 5/1979 Houck
4,492,328 A 1/1985 Munnich et al.
4,654,675 A * 3/1987 Kajikawa et al. ..... 226/195
4,687,125 A 8/1987 Hashimoto et al.
4,829,645 A * 5/1989 Kannwischer ..... 226/194
5,020,431 A * 6/1991 Shibuya ..... 226/195
5,027,462 A 7/1991 Kunzig et al.
5,070,627 A 12/1991 Zagar
5,070,628 A 12/1991 Zagar
5,106,007 A * 4/1992 Lyga ..... 242/615.21
5,199,351 A 4/1993 Shibuya et al.
5,524,805 A * 6/1996 Shiba et al. ..... 226/188
5,573,231 A * 11/1996 Stab ..... 242/615.21
5,577,294 A 11/1996 Pollock
5,906,305 A * 5/1999 Knorr ..... 242/615.21
5,921,452 A 7/1999 Wulf et al.
5,991,964 A 11/1999 Baum

* cited by examiner

*Primary Examiner*—Kathy Matecki
(74) *Attorney, Agent, or Firm*—Dority & Manning, P.A.

(57) ABSTRACT

A turning bar assembly rotatably disposed adjacent a web of material moving at an operational speed in a web forming device has a turning bar for changing a direction of the moving web. Moreover, the turning bar is controllably rotated 360 ° against the moving web to prevent dust accumulation and dust clumping on the turning bar.

27 Claims, 4 Drawing Sheets

TURNING BAR ASSEMBLY FOR USE WITH A MOVING WEB

BACKGROUND OF THE INVENTION

Turning bars for use in a system for manufacturing and processing web material are known. Typically, these known turning bars are found in a web manufacturing machine to turn or redirect a moving web from one direction to another; i.e., to direct the moving web to a finishing station away from the machine direction and then redirect the finished web toward the machine.

The typical turning bar is a unitary component fixed relative to the web manufacturing machine. Since it is fixed and does not rotate, at least one drawback to the known turning bar is that dust accumulates on the turning bar, particularly in the manufacture of a paper web material such as tissue paper. Dust accumulation and subsequent dust clumping on the turning bar have the potential to adversely affect the quality of a finished product, as well as system or machine runnability if the dust accumulates and subsequently falls into the product, for instance, during packaging.

Dust clumping occurs, for example, when the standard fixed turning bar generates static electricity. The non-rotating turning bar thus attracts and holds dust during operation of the system. When the system is even momentarily stopped, dust clumps, which have been held to the turning bar by static electricity, fall into the product, which leads to degraded product quality and consumer dissatisfaction.

Attempts to address the dust accumulation problem include use of compressed air to blow dust off the web before it accumulates on the turning bar or elsewhere. By way of example, a Coanda nozzle is described in U.S. Pat. No. 5,577,294 to Pollock for a "Web Cleaner Apparatus and Method." In Pollock, the Coanda nozzle directs a gas flowing at a high rate of speed in a direction generally opposed to the moving web of sheet material for cleaning a substantially planar surface of the moving web material.

In addition to Pollock, a variety of other air nozzle configurations and area dust containment and removal systems have been tried over the years to address the problems of dust accumulation and clumping. In general, however, compressed air and similar methods tend to create environmental dust problems in a web machine's operating area, which may require workers to don protective masks for respiratory protection and may necessitate costly air-scrubbers to control the blown dust. Accordingly, many previous dust accumulation prevention techniques and apparatuses have tended to increase manufacturing and consumer costs with debatable success.

BRIEF SUMMARY OF THE INVENTION

The present invention is directed to a turning bar assembly rotatably disposed adjacent a web of material moving at an operational speed in a web forming device. The component parts of the invention are simple, reliable, and economical to manufacture, assemble, and use. Other advantages of the invention will be apparent from the following description and the attached drawings or can be learned through practice of the invention.

According to an aspect of the invention, a turning bar assembly is rotatably disposed adjacent a web of material moving at an operational speed of approximately 12–13% of the web speed in a web forming device. The relative speed of 12–13% is provided by way of example only, since the turning bar assembly can be controllably rotated relative to the web at any speed at least less than the speed of the web.

The turning bar assembly includes a roller or a turning bar, which receives, turns and transfers the web down or across stream in the web forming device. For instance, the turning bar may be oriented at 45° to the moving web and when the web contacts the turning bar, the direction of the web is changed 90°. Such redirection or sheet turning by the turning bar may be desirable, for instance, if the web is to be finished at a finishing station located away from the longitudinal direction of the web forming device. Upon finishing the web, another turning bar assembly may be provided downstream to further redirect the web.

The turning bar in one aspect of the invention has a first and a second end. A first mounting end or first mount is attached to the first end and a second mounting end or second mount is attached to the second end. The first end is disposed apart from the second end at a distance of between ten to about forty inches, and an outer diameter of the turning bar is between one inch to about three inches to accommodate the standard web material dimensions. It is within the scope of the invention that the length and the outer diameter of the turning bar can be increased or decreased. Also in this aspect, the turning bar is configured to be controllably rotated 360 degrees relative to the first and second mounts at a speed less than the operational speed of the moving web, such as 1–50% of the web speed, or more specifically 10–20% of the web speed. Web speed can be calculated in a variety of ways and be within the scope of the invention.

According to another aspect of the inventive turning bar assembly, a central or center shaft is disposed longitudinally within the turning bar and fixed to the first and second mounts. In this arrangement, the turning bar is rotatably disposed about the shaft. The turning bar and shaft combination is configured to be removable from the assembly for maintenance and replacement.

In further detail, the turning bar assembly in this aspect includes a plurality of bearings rotatably disposed within the turning bar and about the shaft. The turning bar and the plurality of bearings cooperate to rotate at substantially the operational speed of the moving web. Although the shaft described herein is a unitary shaft extending substantially the length of the turning bar, it is contemplated that the shaft could be formed in multiple pieces. For instance, those portions of the shaft attached to the first and second ends could be severed and apart from each other such that the separate shaft portions extend into the turning bar a sufficient length to support a bearing assembly and be within the scope of the invention.

This aspect also includes a drive apparatus operably connected with the turning bar to rotate the turning bar between about 1/100 to about 1/5 of the operational speed of the moving web. The drive apparatus may include in one embodiment a rod or drive shaft, a drive belt, and a motor or other control mechanism. The drive belt is disposed about a portion of the turning bar and a portion of the rod. The drive belt rotates the turning bar when the rod is rotated by the motor. It is to be noted that a single drive shaft could extend the length of the web-forming device with a plurality of drive belts depending from the single drive shaft and operably connected to a plurality of turning bars. Alternatively, it is contemplated that each of the plurality of turning bars could be controllably rotated by individual drive shafts and drive belts or other independent drive mechanisms and remain within the invention's scope.

In another aspect of the invention, a web forming system is provided, which has a turning bar assembly disposed adjacent a moving web similar to the foregoing embodiment. In this aspect, at least one bearing assembly is disposed concentrically about the shaft within the turning bar. The bearing assembly is configured to allow the turning bar to rotate about the shaft and includes a plurality of bushings and bearings to rotatably attach the turning bar about the shaft. The bushings may be bronze bushings, phenolic bushings, or of other suitable materials to adapt the first and second ends to the shaft.

Once mounted in the web-forming device, the bushings and bearings permit the turning bar to continuously change an aspect or a portion contacting the moving web. Due to this controlled rotation, the dust is substantially constantly dispersed by the turning bar rotating at a speed less than the moving web, which creates drag to prevent dust accumulation and build-up on any single point of the turning bar and the web. Drag also controls sheet handling since the web will "walk out" of the machine if the turning bar is permitted to free-wheelingly rotate. If desired, the turning bar can be configured to rotate in a direction opposite the moving web to further prevent dust accumulation on the turning.

In a further aspect of the invention, a turning bar assembly for use in manufacturing a paper web is provided. The turning bar as generally described above is affixed to a holder and configured to redirect the web from moving in one direction to moving in another direction as the web passes across the turning bar. More specifically, in this embodiment, a tube-like sleeve is rotatably disposed about the turning bar and rotates about the turning bar at substantially less than the operational speed of the web. Stated alternatively, the turning bar is fixed in this aspect while the tubular sleeve, for instance, rotates around the fixed turning bar and a plurality of bearings is disposed about the turning bar. The plurality of bearings in this aspect could be substituted with, for instance, plastic or bronze bushings, lubricant such as grease and the like and still permit the sleeve to rotate about the fixed turning bar.

According to another aspect of the invention, a method for precluding dust accumulation on a turning bar in a web manufacturing system is disclosed, which includes the steps of providing a turning bar rotatably disposed against a moving web of material; redirecting the moving web by the turning bar from a first incoming direction to a second outgoing direction; dispersing a dust originating from the moving web away from the turning bar by rotating the turning bar; and controlling the rotation of the turning bar between about 1% a speed of the moving web to some rotation speed less than the speed of the web.

Additional objects, features, and advantages of the invention will become apparent to those skilled in the art upon consideration of the attached drawings in conjunction with the following detailed description of the drawings which exemplifies the best mode of carrying out the invention as presently perceived, or can be learned through practice of the invention.

BRIEF DESCRIPTION OF THE DRAWINGS

The above and other aspects and advantages of the present invention are apparent from the detailed description below and in combination with the drawings, in which.

DETAILED DESCRIPTION OF THE DRAWINGS

Figure 1:
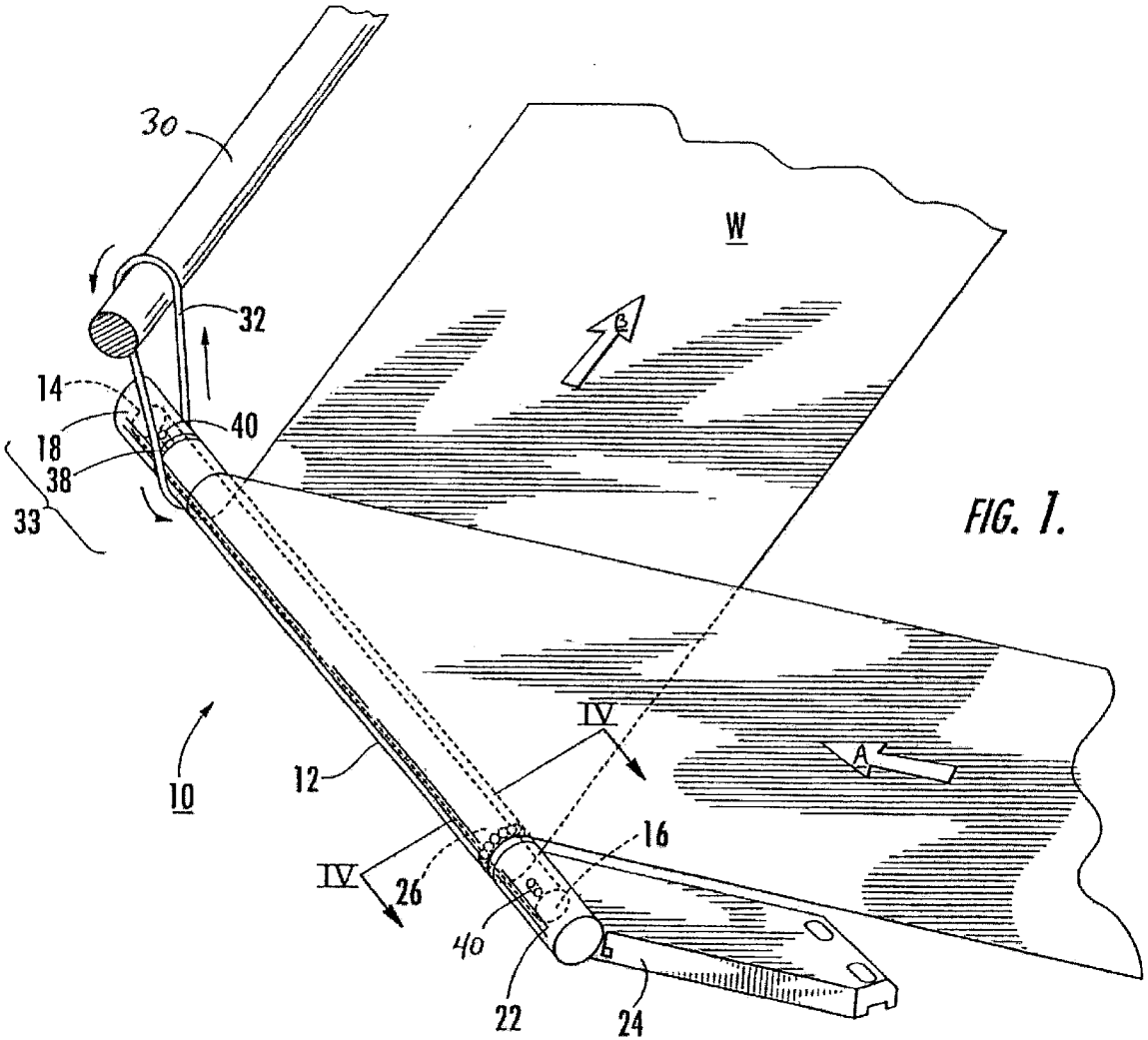
FIG. 1 is a partial perspective view of a web forming device particularly showing a turning bar assembly and a partial section of a web material moving adjacent a turning bar according to the present invention.

Detailed reference will now be made to the drawings in which examples embodying the present invention are shown. Repeat use of reference characters in the present specification and drawings is intended to represent same or analogous features or elements of the invention.

The drawings and the following detailed description provide a full and detailed written description of the invention and the manner and process of making and using it, so as to enable one skilled in the pertinent art to make and use it. The drawings and detailed description also provide the best mode of carrying out the invention. However, the examples set forth herein are provided by way of explanation of the invention and are not meant as limitations of the invention. The present invention thus includes modifications and variations of the following examples as come within the scope of the appended claims and their equivalents.

Figure 2:
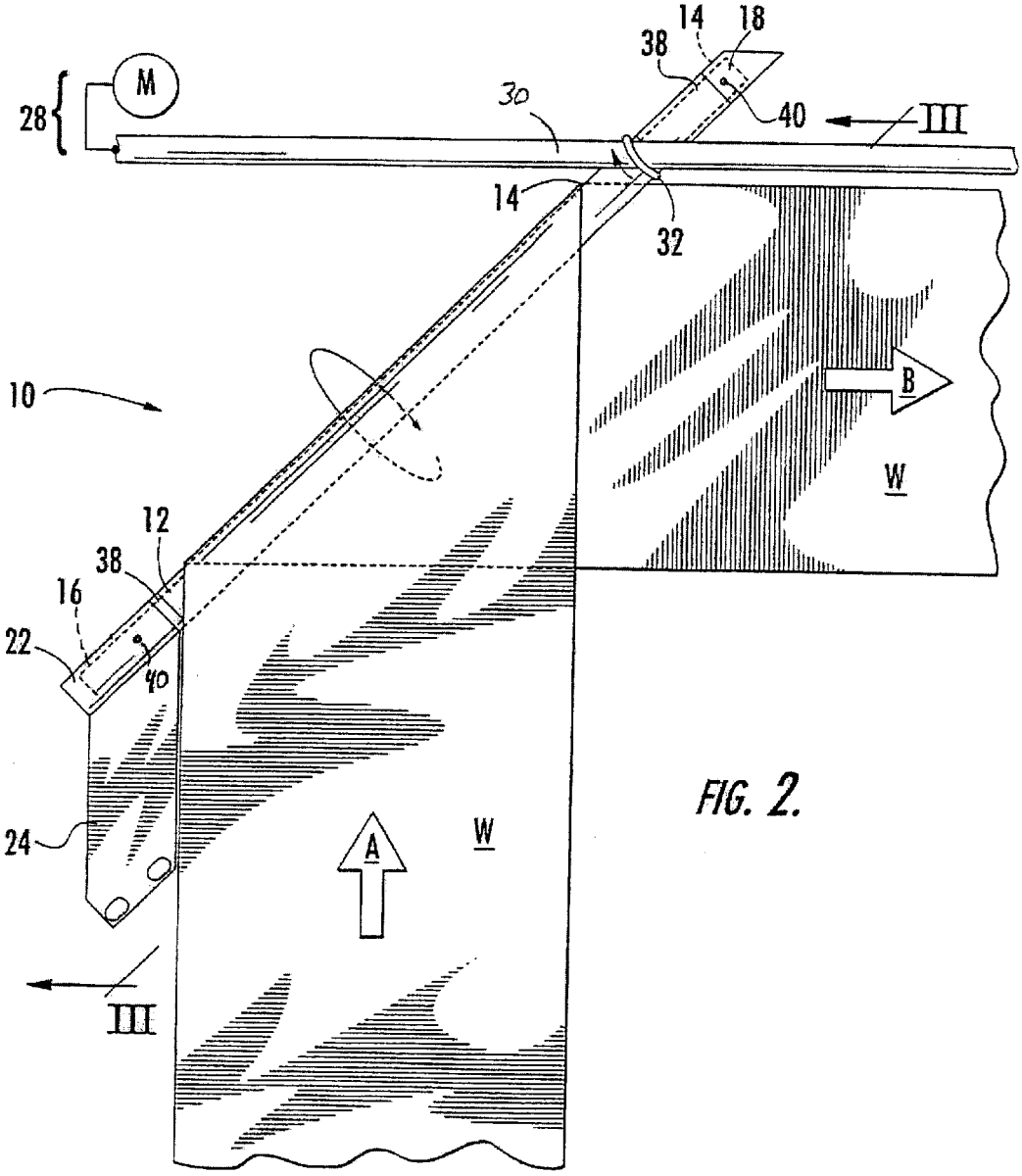
FIG. 2 is a top perspective view of the embodiment as in FIG. 1.
Figure 3:
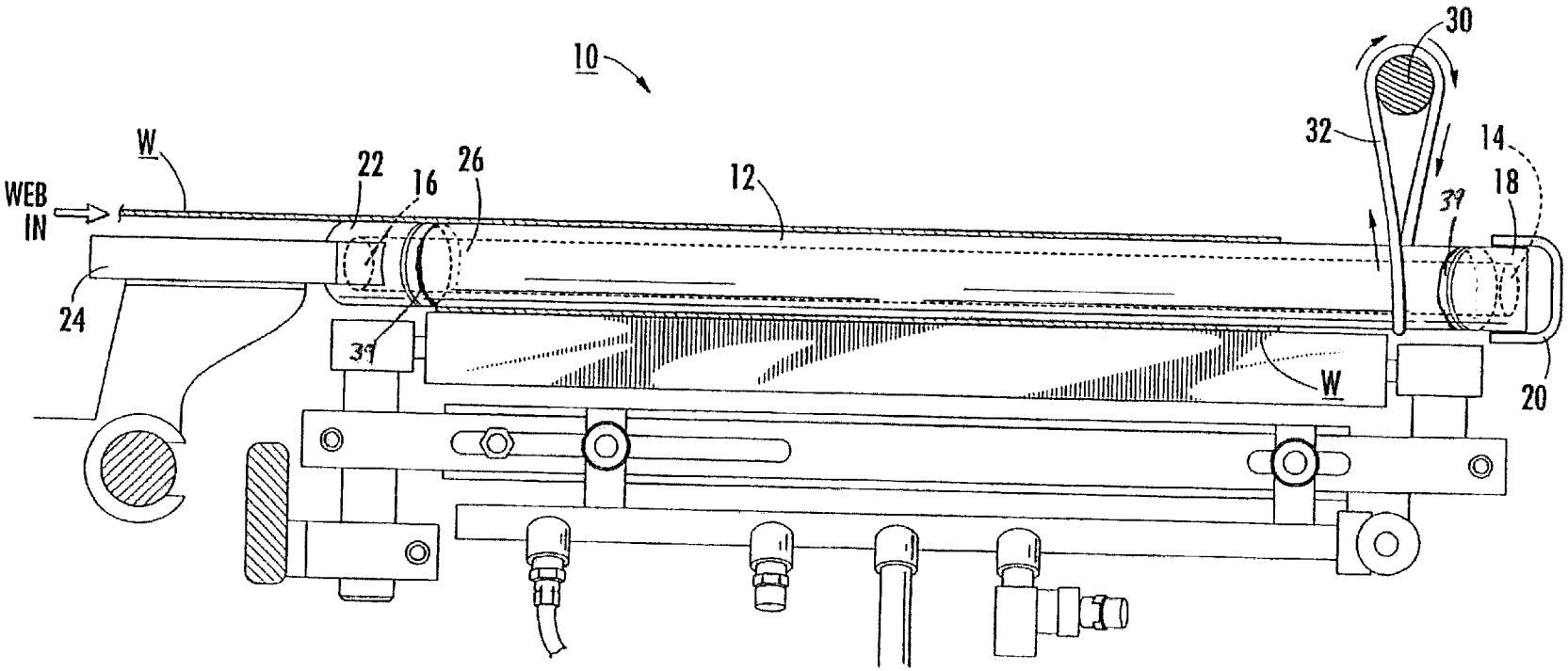
FIG. 3 is a view of the arrangement as in FIG. 1 or 2 taken in the direction of line 111—111 in FIG. 2.

As broadly embodied in the Figures, a turning bar assembly 10 is rotatably disposed adjacent a web of material W moving at an operational speed in a web forming device (shown in part in FIGS. 1–3). The turning bar assembly 10 includes a roller or turning bar 12, which may be circular in cross-section but can have other shapes such as conical, concave, convex or the like. The turning bar 12 has a first end 14 and a second end 16 and is configured to receive, turn and transfer the web W downstream or across stream in the web forming device. More specifically, a first mounting end or mount 18 is attached to the first end 14 of the turning bar 12. A second mounting end or mount 22 is attached to the second end 16. In this arrangement, the turning bar 12 is configured to rotate 360 degrees relative to the first and second mounts 18, 22 at less than the operational speed of the moving web W.

Generally, the turning bar 12 is controllably, rotationally driven by drive apparatus 28, as shown in FIG. 2, which may include a drive belt or o-ring 32, a drive rod or shaft 30 and motor M as will be further described below. It should be noted that the turning bar 12 can be driven by mechanisms other than as shown in the drawings, such as by a drive unit directly electromotively coupled to the turning bar 12. By way of example, a direct drive block and motor could be rotatably attached to the first mount 18 to linearly drive the turning bar 12 in lieu of the offset shaft 30/belt 32 combination. Accordingly, various drive arrangements are contemplated for rotating the inventive turning bar 12 without departing from the purpose and scope of the invention.

In one aspect of the invention, the turning bar 12 is disposed at an angle other than 90° to the moving web W moving in a first direction A such that the turning bar 12 turns the moving web W in a second direction B as seen, for example, in FIGS. 1 and 2. The turning bar 12 in this aspect is rotatably configured to frictionally contact the moving web W at relatively different speeds such that dust from the moving web W does not accumulate on the rotating turning bar 12. Stated another way, a nominal frictional force is created between a surface of the web W and the surface of the rotating turning bar 12 due to their relative speed differences, detailed below. This friction tends to remove dust from the turning bar 12 while assuring directional control of the moving web W. More specifically, the controlled speed ratio of the rotating turning bar 12 to the moving web W ensures that the dust is substantially constantly dispersed to prevent dust accumulation and build-up on the turning bar 12 and the web W.

By way of example, the drive belt 32 is disposed about a portion of the turning bar 12. The shaft 30 and drive belt 32 cooperate to rotate the turning bar 12 when the drive apparatus 28 rotates the shaft 30 by the motor M. It is to be noted that although the shaft 30 is shown offset and above the turning bar 12, other relative arrangements and geometries are possible to rotate the turning bar 12. Further, the drive apparatus 28 could include a computer or other control device to program motor M, for instance, if automatic speed governoring or system start/stop is desired. Also if desired, the turning bar 12 in this aspect of the invention may be rotated in a direction opposite the moving web W to further reduce dust accumulation on the turning bar 12 such as by the creation of additional drag between the bar 12 and web W.

With more particular reference to FIGS. 1–4, the shaft 26 is shown disposed longitudinally within the turning bar 12 and affixed to the first and second mounting ends 18, 22. The turning bar 12 is rotatably disposed about the shaft 26. Although the shaft 26 described herein is a unitary shaft extending substantially the length of the turning bar 12, it is contemplated that the shaft 26 could be formed in multiple pieces. For instance, those portions of the shaft 26 attached to the first end 14 and second end 16 of turning bar 12 could be severed and apart from each other such that the separate shaft portions extend into the turning bar 12 a sufficient distance to support a bearing assembly 33, including bearings 34, bushings 38 and spring pins 40, as will be described below.

As shown in FIG. 3, the first mounting end 18 in this aspect is angled and removably attached to a first point or holding channel 20. The second mounting end 22 is removably attached to a second point or mounting bracket 24. A variety of other holders or holding elements other than channel 20 and bracket 24 can be provided. However, the inventors have found that the angled mounting end 18 and holding channel 20 facilitate maintenance and/or replacement of the turning bar assembly 10. Further, the angled mounting tip 18 serves to facilitate longitudinal adjustments to turning bar 12. Moreover, the turning bar 12 can be rotated such that if the turning bar 12 is held in place or is non-rotatable, the bar 12 can be revolved to increase longevity of the bar 12. Eventually, the turning bar 12 can be repaired/replaced without replacement of the entire turning bar assembly 10, such as mounts 20 and 24.

Figure 4:
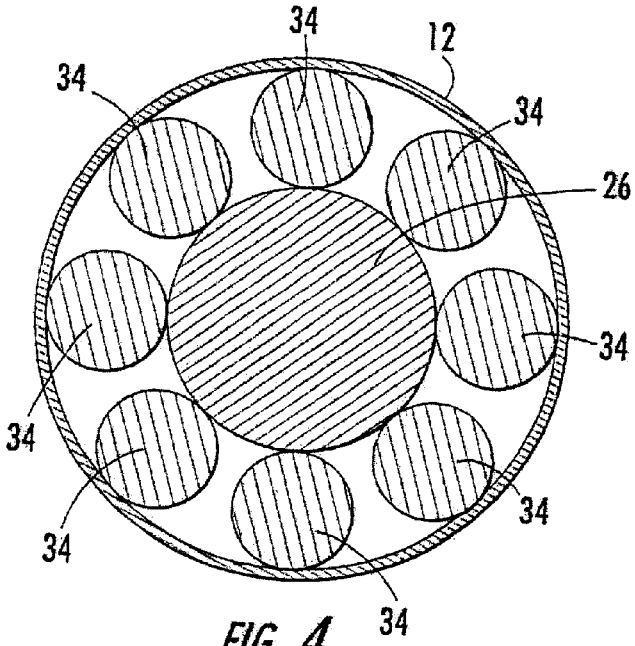
FIG. 4 is a cross-sectional view taken along lines IV—IV in FIG. 1 particularly showing a bearing arrangement in accordance with the invention.

FIG. 4 particularly illustrates a plurality of bearings 34 rotatably disposed within the turning bar 12 and about the shaft 26. The bearings 34 cooperate to rotate the turning bar 12 at less than an operational speed of the web W in the web forming device. More specifically, in this aspect of the invention, the turning bar 12 and the plurality of bearings 34 are rotated by the drive apparatus 28 between 1% to about 20% of the operational speed. The bearings may be standard ball-type bearings or other standard antifriction bearings such as tapered rollers, needle rollers, or the like.

Optionally, the turning bar 12 may define a plurality of holes (not shown), which are configured to direct a pressurized gas via the turning bar 12 into contact with the moving web W. Use of a pressurized gas such as from a Co and a nozzle is known in the art and can be used for supplemental dust removal from the rotating turning bar 12 of the present invention if desired.

The first end 14 of the turning bar 12 may be disposed apart from the second end 16 between ten to about forty inches. An outer diameter D of the turning bar may be between ¼ inch to about eight inches. It should be noted that although these turning bar 12 dimensions accommodate the standard web material, a variety of other shapes and sizes for the turning bar 12 are contemplated by the invention.

With further reference to FIGS. 1–4, at least one bearing assembly 33 is disposed concentrically about the shaft 26 within the turning bar 12. The bearing assembly 33 permits the turning bar 12 to rotate about the shaft 26 as previously described and includes the bearings 34 as described, bushings 38, and spring pins 40.

The bushings 38 are affixed to adapt the first and second ends 14, 16 to the shaft 26. The bushings 38 may be selected from bronze bushings, phenolic bushings, steel, aluminum, brass, plastic and the like, depending on particular system requirements or specifications. The spring pins 40 hold the assembly 33 together as known and need not be further described to practice the invention. As seen in FIG. 3, a thrust washer 39 may be disposed between first mounting end 18, for instance, and bar 12 as a spacer to prevent braking of the bar. Likewise, a thrust washer 39 can be inserted between the opposite end of bearing 34 and the second mounting end 22. Such thrust washers provide clearance between the bearing 34 and other elements to prevent unnecessary friction or braking while the turning bar 12 is rotating.

Figure 5:
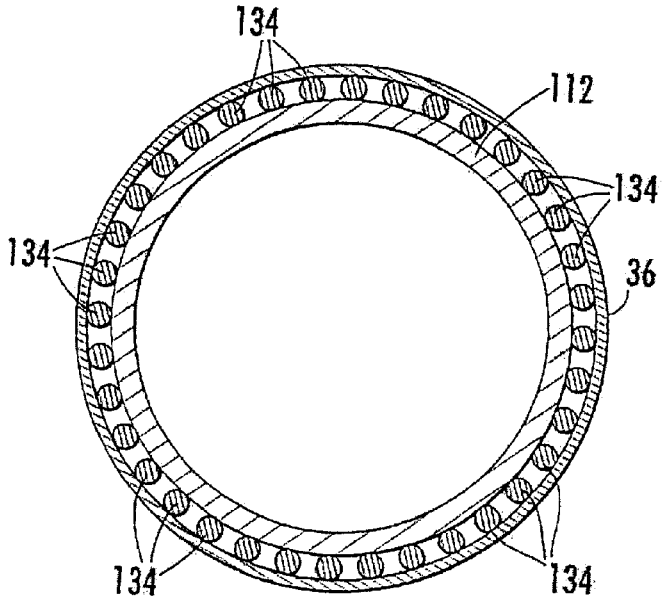
FIG. 5 is a cross-sectional view of an alternative bearing arrangement.

In another aspect of the invention, as seen in pertinent part in FIG. 5, a turning bar assembly 10 for use in manufacturing a paper web W similar to the foregoing embodiments is provided. A turning bar 112 is affixed to a holder similar to bracket 24 and/or channel 20 in which the previously described turning bar 12 is mounted. A sleeve 36 is rotatably disposed about the turning bar 112. In this aspect, the first mounting end 18 and a second mounting end 22 are fixed to the turning bar 112 such that the first mounting end 18 and the second mounting end 22 are removably affixed to the bracket 24. In contrast to the embodiment shown in FIG. 4, a plurality of bearings 134 is disposed about the turning bar 112 and the sleeve 36 is rotatably disposed about the plurality of bearings 134. Thus, the sleeve 36 is rotated about the turning bar 112 at substantially an operational speed of the web W by the drive apparatus 28.

With further reference to the drive apparatus 28, the motor M along with a controller such as a computer can be configured to rotate the turning bar 12 or sleeve 36 at variable speeds depending on system requirements. For instance, a speed between 1/100 to ½ of the operational speed as described above may be programmed into the controller or directly into a programmable motor M. By way of example, the motor M can be programmed to alternately or selectively drive the turning bar 12 for a predetermined period of time at ⅕ of the operational speed followed by 1/100 of the operational speed for a time and subsequently stop or freewheel the turning bar 12 until returning it to ⅕ of the operational speed for another period of time. Obviously, a number of programmable turning bar 12 speeds are contemplated by the present invention.

A method for precluding dust accumulation on a turning bar 12 in a web manufacturing system is disclosed in one aspect of the invention as seen in FIGS. 1–3. The method includes the steps of providing the turning bar 12 rotatably disposed against a moving web W of material; redirecting the moving web W by the turning bar 12 from a first incoming direction A to a second outgoing direction B; dispersing a dust that originates, for example, from the moving web W away from the turning bar 12 by rotating the turning bar 12; and controlling the rotation of the turning bar 12 from between 1/100 a speed of the moving web W to about substantially the speed of the web W. The method may include the substep of selectively rotating the turning bar 12 in a direction opposing the movement of the web W.

While exemplary embodiments of the invention have been shown and described, those skilled in the art will recognize that other changes and modifications may be made to the foregoing examples without departing from the scope and spirit of the invention. For instance, specific shapes of various elements as shown in the drawings may be altered to suit particular applications. It is intended to claim all such changes and modifications as fall within the scope of the appended claims and their equivalents.

That which is claimed is:

1. A turning bar assembly rotatably disposed adjacent a web of material moving at an operational speed in a web forming device, the turning bar assembly comprising:

a turning bar having a first end and a second end and configured to guide the web in the web forming device;

a first mount attached to the first end and a second mount attached to the second end, the turning bar configured to be controllably rotated 360 degrees relative to the first and second mounts at a speed relative to the operational speed of the moving web to preclude a dust accumulation on the turning bar;

a shaft disposed within the turning bar and affixed to the first and second mounts;

a plurality of bearings rotatably disposed within the turning bar about the shaft; and a drive apparatus having a rod and a drive belt, the drive belt disposed about a portion of the turning bar and about a portion of the rod, the drive belt configured to rotate the turning bar about the bearings and the shaft at between 1% to about 50% of the operational speed of the moving web when the rod rotates.

2. The turning bar assembly of claim 1, wherein the turning bar operates at between 1/70 to about 1/5 of the operational speed of the web.

3. The turning bar assembly of claim 1, wherein the first end is disposed apart from the second end between twelve to about thirty inches.

4. The turning bar assembly of claim 1, wherein the first end is disposed apart from the second end between ten to about forty inches.

5. The turning bar assembly of claim 1, wherein an outer diameter of the turning bar is between 1/4 inch to about 8 inches.

6. The turning bar assembly of claim 5, wherein the outer diameter is between one inch to about two inches.

7. The turning bar assembly of claim 1, further comprising a plurality of thrust washers configured to space the turning bar apart from the first and second mounts.

8. The turning bar assembly of claim 1, further comprising a motor in communication with the shaft, the motor configured to rotate the shaft.

9. The turning bar assembly of claim 1, wherein the turning bar assembly is configured to be removable from the web forming device for one of maintenance and replacement.

10. The turning bar assembly of claim 9, wherein the turning bar defines an angled mounting end configured to remove the turning bar from the turning bar assembly for one of maintenance and replacement.

11. In a web forming system, a turning bar assembly disposed adjacent a web, the web moving at an operational speed between 200 feet per minute to about 2000 feet per minute, the turning bar assembly comprising:

a turning bar having a first end and a second end, the turning bar configured to contact the web as the web passes in a downstream direction and redirect the web away from the downstream direction;

a shaft disposed within the turning bar, the shaft affixed to a first holding point and a second holding point, the first and second holding points located proximate the first end and the second end of the turning bar;

at least one bearing assembly disposed concentrically about the shaft within the turning bar, the at least one bearing assembly configured to allow the turning bar to rotate about the shaft; and means for rotating the turning bar about the shaft between 1/100 to 1/5 of the operational speed.

12. The turning bar assembly of the web forming system as in claim 11, the turning bar configured to rotate in a direction opposite the moving web.

13. The turning bar assembly of the web forming system as in claim 11, further comprising a drive apparatus in operative communication with the means for rotating, the drive apparatus configured to drive the means for rotating to rotate the turning bar.

14. The turning bar assembly of the web forming system as in claim 11, wherein the at least one bearing assembly includes a plurality of bushings configured to adapt the first and the second ends to the shaft, the plurality of bushings selected from the group consisting of bronze bushings, phenolic bushings, steel, aluminum brass and plastic.

15. The turning bar assembly of the web forming system as in claim 11, wherein the turning bar is disposed at an angle other than 90° to the moving web moving in a first direction such that the turning bar turns the moving web in a second direction.

16. The turning bar assembly of the web forming system as in claim 11, wherein the turning bar is configured to continuously change a portion of the turning bar contacting the moving web such that a dust from the web does not accumulate on the turning bar.

17. The turning bar assembly of the web forming system as claimed in claim 16, wherein the dust is substantially constantly dispersed by the turning bar to avoid dust accumulation and build-up on the turning bar and the web.

18. A turning bar assembly for use in manufacturing a paper web, the turning bar assembly comprising:

a turning bar affixed to a holder, the turning bar configured to redirect the web from moving in one direction to moving in another direction as the web passes across the turning bar;

a sleeve rotatably disposed about the turning bar, the sleeve configured to rotate about the turning bar at substantially an operational speed of the web; and a drive apparatus including a drive shaft, a drive belt and a control mechanism, the drive belt disposed about a portion of the sleeve and about a portion of the drive shaft, the control mechanism configured to control a revolution of the drive shaft such that the revolution of the drive shaft turns the drive belt to rotate the sleeve.

19. A The turning bar assembly of claim 18, wherein the holder defines a first point and a second point and the turning bar has a first mounting end and a second mounting end, the first mounting end removably affixed to the first point, the second mounting end removably affixed to the second mounting end such that the sleeve rotates about the turning bar.

20. The turning bar assembly of claim 18, further comprising a plurality of bearings disposed about the turning bar, the sleeve rotatably disposed about the plurality of bearings.

21. The turning bar assembly of claim 18, wherein the drive apparatus is further configured to rotate the sleeve at variable speeds between 1/100 to 99/100 of the operational speed, and to selectively stop the sleeve while the web moves.

22. A method for precluding dust accumulation on a turning bar in a web manufacturing system, the method comprising the steps of:

providing a turning bar rotatably disposed against a moving web of material;

redirecting the moving web by the turning bar from a first incoming direction to a second outgoing direction;

dispersing a dust away from the turning bar by rotating the turning bar; and controlling the rotation of the turning bar between 1/100 the speed of the moving web to about substantially the speed of the web.

23. The method of claim 22, wherein the turning bar is rotated in a direction opposing the moving web.

24. The method of claim 22, further comprising the steps of removing the turning bar, rotating the turning bar, and reinstalling the turning bar in the turning bar assembly.

25. The method of claim 22, further comprising the step of creating a drag by the rotation of the turning bar against the moving web to prevent a walk-out of the moving web during the step of redirecting from the first incoming direction to the second outgoing direction.

26. A turning bar assembly rotatably disposed adjacent a web of material moving at an operational speed in a web forming device, the turning bar assembly comprising:

a turning bar having a first end and a second end, the turning bar configured to frictionally guide a moving web from a first angular direction to a second angular direction such that the moving web will not walk out of the web forming device;

a first mount attached to the first end and a second mount attached to the second end;

a shaft disposed within the turning bar and affixed to the first and second mounts; and a drive rod configured to rotate the turning bar 360 degrees about the shaft relative to the first and second mounts at between about 1% to about 50% of the operational speed of the moving web to preclude a dust accumulation on the turning bar.

27. The turning bar assembly as in claim 26, further comprising a control mechanism in communication with the drive rod, the control mechanism configured to control a revolution of the drive rod such that the revolution of the drive rod rotates the turning bar.

* * * * *